United States Patent [19]

Garland

[11] Patent Number: 4,771,862

[45] Date of Patent: Sep. 20, 1988

[54] LADDER GUARDS

[75] Inventor: Patrick J. Garland, Green Bay, Wis.

[73] Assignee: Tufco Industries Inc., Green Bay, Wis.

[21] Appl. No.: 146,974

[22] Filed: Jan. 22, 1988

[51] Int. Cl.[4] ..... E06C 7/48

[52] U.S. Cl. ..... 182/108; 182/214

[58] Field of Search ..... 182/108, 107, 214

[56] References Cited

U.S. PATENT DOCUMENTS

| | | | |
|---|---|---|---|
| 1,964,067 | 6/1934 | Leach | 182/108 |
| 2,138,171 | 11/1938 | Johnson | 182/111 |
| 2,643,046 | 6/1953 | Wilson | 229/53 |
| 2,872,094 | 2/1959 | Leptien | 229/3.5 |
| 2,904,128 | 9/1959 | Boham | 182/108 |
| 2,925,877 | 2/1960 | Wright | 182/108 |
| 2,992,696 | 7/1961 | Jedinak | 182/108 |
| 3,062,319 | 11/1962 | Wright | 182/108 |
| 3,115,212 | 12/1963 | Keatley | 182/108 |
| 3,598,677 | 8/1971 | Bergmeister et al. | 156/276 |
| 3,662,856 | 5/1972 | D'Amico | 182/108 |
| 3,689,431 | 9/1972 | Payne | 252/313 |
| 3,860,431 | 1/1975 | Payne et al. | 106/36 |
| 3,901,987 | 8/1975 | Payne | 428/219 |
| 3,929,208 | 12/1975 | Hendrich | 182/108 |
| 3,930,063 | 12/1975 | Miller et al. | 427/54 |
| 3,981,820 | 9/1976 | Miller et al. | 252/301 |
| 3,993,163 | 11/1976 | Barrett | 182/108 |
| 4,418,111 | 11/1983 | Carstens | 428/154 |
| 4,683,980 | 8/1987 | Vayko | 182/108 |

*Primary Examiner*—Reinaldo P. Machado

*Attorney, Agent, or Firm*—Andrus, Sceales, Starke & Sawall

[57] ABSTRACT

A top ladder guard is telescoped over the upper end of each siderail of a ladder to provide a protective mounting against a vertical supporting wall structure. Each ladder guard is a single piece cup-shaped member which is molded of a suitable soft rubber-like plastic and includes a body portion of a rectangular cross-section to fit over the upper end of a siderail and an integral outer curved end wall having a substantially curved configuration. The body portion includes a pair of main sidewalls formed as essentially smooth continuous members of an essentially constant thickness and a pair of narrow walls joining said main sidewall. The narrow walls are molded with a serpentine cross-section to form an accordian or expandable structure permitting expanding and contracting of the narrow walls. The narrow walls provide limited flexibility of the body portion for tight telescoping engagement with different sized siderails.

8 Claims, 1 Drawing Sheet

LADDER GUARDS

BACKGROUND OF THE PRESENT INVENTION

Present inventions related to ladder guards and particularly to guard elements secured to the upper end of the side rails of a ladder for mounting against the vertical support wall for minimizing of any damage to such support walls.

Ladders are widely used for working on above the ground levels. A widely used ladder includes a pair of side rails interconnected by longitudinally spaced steps or rungs which extend between and are firmly affixed to the side rails. The upper end of the side rails will project upwardly from the uppermost rung or step a short distance and provide for interengagement to a vertical support. The bottom end of the side rails more suitably constructed to rest on the ground or floor area for supporting of the ladder at an appropriately inclined position against the vertical support. Various prior art pad-type devices have been suggested to be attached to the upper ends of the side rails for purposes of protecting a vertical wall from damage as a result of engagement by the rigid side rails and also to improve the stability of the ladder on the support structure. For example, U.S. Pat. No. 138,171 which issued Nov. 29, 1938, for an anti-slip device discloses cupped elements formed of a rubber like material which are fitted over the upper end of the ladder siderail. The rubber-like material is formed with extended portions to distribute the applied pressure or force of the ladder over a somewhat larger area and also stabilizes the inter-connection by providing a greater frictional engagement with the wall. The patent also provides for roughening of the wall engaging portion to increase the friction forces. As disclosed in that patent, cupped element has its socket formed to closely fit over the ladder to secure the element in place.

Various other similar devices have been suggested in the prior art. U.S. Pat. No. 2,925,877 which issued Feb. 23, 1964 discloses a similar element having an enlarged bumper portion projecting laterally outwardly from the body portion and having a planar surface adapted to engage the vertical wall. The vertical wall engaging surface is provided with a plurality of parallel longitudinal grooves. A somewhat similar pad like structure is shown in U.S. Pat. No. 3,929,208 which issued Dec. 30, 1975, for a "Ladder Bearing Plate" in which a cap member is provided with a screw like attachment to the upper end of the ladder and with an outer flat pad for abutting the wall surface. More recently, a rubber cap member has been proposed in which the outer upper end is curved to conform to the curved ladder ends widely used in present day ladder structures. The element is formed of a rubber like material with corrugate end wall extending completely around the guard the end walls is integral with flat sidewalls for attachment to the upper end of the ladder.

End guards also protect the ends of the ladder from accumulated water as well as nicks, scratches, gouges on the ends which otherwise are often encountered during the use of the ladder.

Although the prior art provides satisfactory devices for protecting the wall and promote stabilization of the ladder on the wall, none of the devices appear to provide an optimum type of a support at a minimum cost, with most efficient and low cost production and wherein the portion of the ladder engaging the wall provides maximum surface engagement for maximizing stability of the ladder.

SUMMARY OF THE PRESENT INVENTION

The present invention is directed to a simple but effective and reliable ladder guard which can be readily affixed to the upper end of a ladder structure and maintain proper and effective stability of the ladder while protecting of the engaging vertical surface. Generally, in accordance with the teaching of the present invention the ladder guard is formed with an end wall portion having a curved outer end and integral body portion to conform to the upper end of the siderails of present day ladder structures. The body portion is perferably formed with a rectangular cross-section and includes parallel straight wall portions aligned with the wall engaging edges of the siderails. The straight wall portions are formed of a generally longitudinal grooved construction and the end wall is formed with an essentially smooth continuous outer surface. The grooved construction in the straight wall portions introduce a certain amount of flexibility into the wall portions and adapt the guard to different sized ladders and particularly the siderails. The grooved wall portions are formed in single-piece molded construction with an accordian or serpentine cross-section to establish an expanding and contracting wall structure for conforming to the cross-section of the siderails. The upper curved wall is formed as an integral member with the straight walls and having the smooth outer surface to provide a maximum bearing surface to the supporting wall. The combination of the grooved expandable sidewalls and the smooth upper end wall provides a highly protective guard element which can be readily assembled to various sized ladders. Thus, the grooved walls particularly permit the movement of the guard over the upper end of the ladder without undue complications as a result of the variations in the size of the siderails with respect to the guard socket or cavity. The smooth upper wall structure maintains sufficient flexibility to conform to the upper end of the ladder, while minimizing slippage of the ladder to provide more safe and stable use. The large soft rubber surface of the curved end wall minimizes scratches, dents and the like on the wall surface and thus avoids damage to the structure.

BRIEF DESCRIPTION OF THE DRAWING

The drawing furnished herewith generally illustrates the best mode presently contemplated for the invention and are described hereinafter.

In the drawing.

DESCRIPTION OF THE ILLUSTRATED EMBODIMENT

Figure 2:
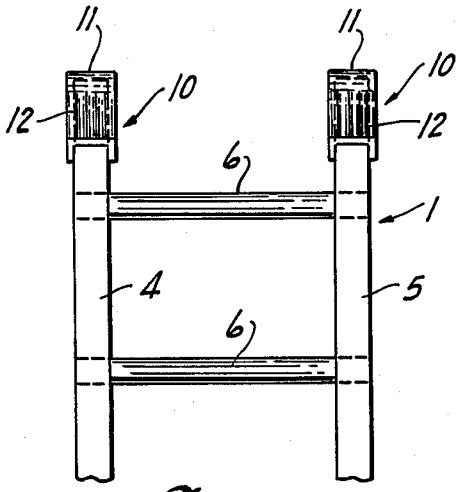
FIG. 2 is a front view of FIG. 1.
Figure 1:
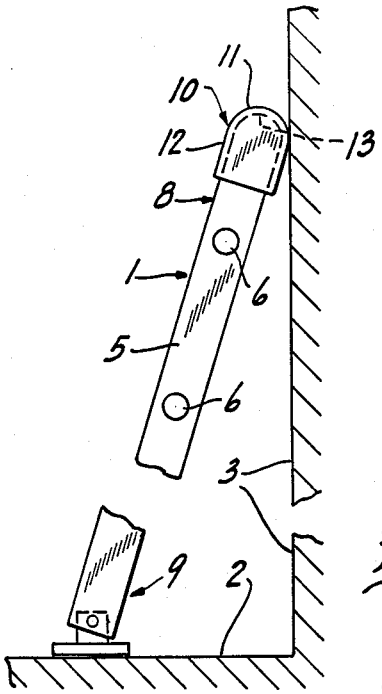
FIG. 1 is a fragmentary side elevational view of a ladder abutting a wall structure in the in-use position and incorporating a ladder guard on the upper end thereof in accordance with the teaching of the present invention.

Referring to the drawing and particularly to FIGS. 1 and 2, a typical ladder 1 is illustrated in a raised used position with the lower end resting on the ground 2 and the upper end abutting a supporting flat wall 3. The ladder 1 is illustrated as a conventional known metal ladder having a pair of laterally spaced siderails 4 and 5 interconnected by a plurality of interconnecting steps or rungs 6. The siderails extend upwardly as at 8 and downwardly as at 9 beyond the end rungs 6 to provide the supporting ends for ground-engaging and wall-engaging support as illustrated in FIG. 1. In accordance with the present invention, special ladder guard elements 10 are secured to the upper end of the siderails. The ladder guards 10 are particularly formed of a rubber-like material and are adapted to fit firmly under tension over the upper ends 8 of the ladder's siderails and provide a smooth wall engaging wall portion 11 bearing on the vertical support wall 3. The surface 11 is integral with a body portion 12 having straight end wall portions 14 which telescope over the straight edges of the siderails.

The ladder structure may be of any readily conventional and widely used form or construction. The present invention is particularly directed to the particularly structure of the ladder guards. Consequently, the ladder is not described in any further detail other than as necessary to fully explain or fully understand and described the illustrated embodiment of the present invention.

More particularly, the upper ends of the siderails 4 and 5 may be formed with a generally curved end member 13 but generally are formed with a square upper end. The conventional aluminum ladder for example may have separate curved endwall elements secured to the upper most end of the side rail. The ladder of course may also be formed of other materials including wood, in which event, the upper end may be integrally formed with the curved or square configuration.

The guards 10, which are constructed in accordance with the teaching of the present invention, are molded single piece elements formed of a suitable rubber-like material such as thermal plastic rubber. The guards are structured to permit convenient commercial molded production while establishing effective anti-slip and protective characteristics. The material is preferably relatively firm but a resilient rubber-like material to provide cushioning of the ladder against the wall and minimizing damage to the wall structure, as well as minimal slippage. The guard is also designed to accommodate various size siderails, which vary with the size of the ladder and with different manufactures and designs.

Figure 3:
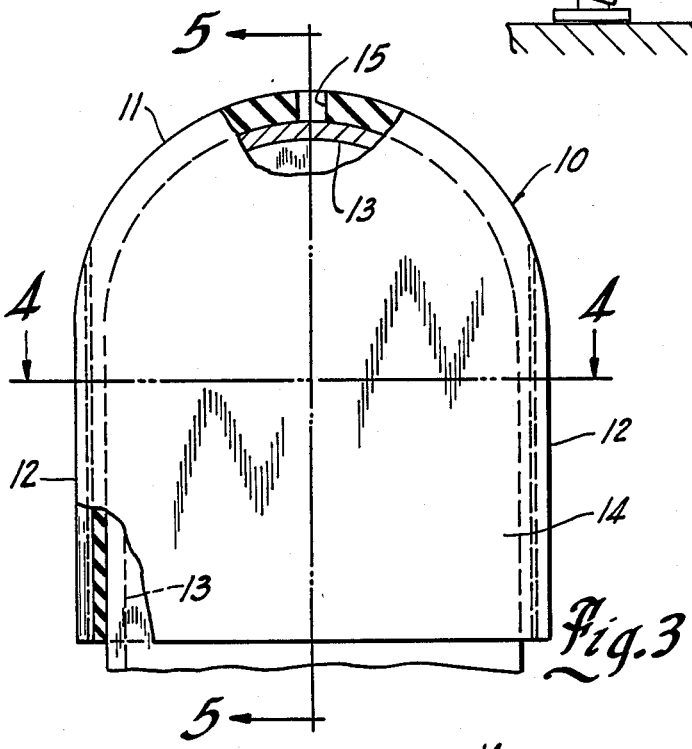
FIG. 3 is an enlarged view of the upper end of the ladder shown in FIG. 2, with parts broken away and sectioned.
Figure 5:
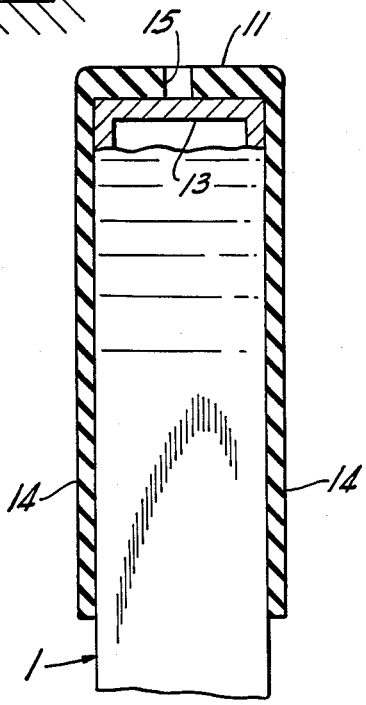
FIG. 5 is a vertical section taken generally on line 5—5 of FIG. 3.
Figure 4:
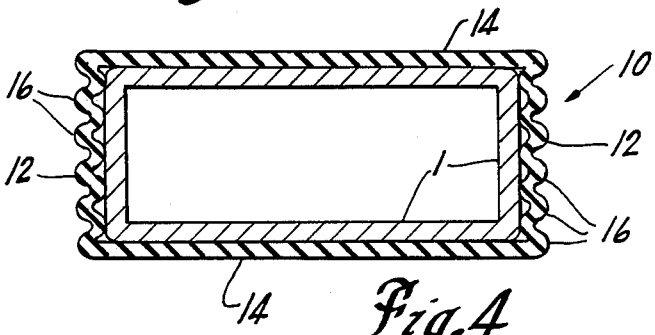
FIG. 4 is a horizontal section taken laterally on line 4—4 of FIG. 3.

More particularly, the ladder guards include the rectangular telescoping body portion including the straight narrow walls 12 aligned with the wall engaging edges and main siderails joining the narrow walls 12 and all integral with the upper outer curved end wall portion. As shown most clearly in FIGS. 3 and 4, the essentially smooth main sidewalls 14 are integral with the walls 12 to form an essentially closed socket. The outer end wall portion 11 includes an air release opening 15 for convenient telescoping over the end of the ladder siderails.

In accordance with the present invention, the straight walls 12 of the body portions are specially constructed with a plurality of longitudinally extending grooves 16 which terminate at the beginning of the curved end wall portion 11. The grooves 16 create a somewhat reduced thickness throughout the wall portions 12. This increases the flexibility and stretchability of the corresponding telescoping portion for purposes of adapting the ladder guards to the ladders and particularly the siderails of different sizes. The principal or large main sidewalls 14 are formed as integral single thickness members to maintain maximum strength. The flexible walls permit the slipping of the ladder guards downwardly over the ladders of different sizes with minimum difficulty and friction forces. Thus, in all instances, the guard firmly grips the ends of the ladder.

The groove construction can be formed in any desired or suitable manner. For example, particularly in molded ladder guards, which is a preferred form of construction, the grooved portion is formed by a molding the straight walls with corrugated or accordian type wall, including a serpentine cross-section as illustrated most clearly in FIG. 4. The ladder grooves thus appear on both surfaces and provides convenient expansion and contraction of the opposite walls 12 for accommodating the different widths and depths of the siderails. The corrugated structure as shown projects from the outer end of the socket inwardly and terminates at or slightly into the upper curved end portion 11. Thus, the curved portion 11 of the guard is, in accordance with the present invention, formed with exterior solid flat faces to present a corresponding flat rubber-like surface for engagement with the wall structure. Slight roughing of the surface of portion 11 may be provided, if desired. This combination has been found to minimize damage to the wall structure without interfering with the convenient and rapid assembly of a rubber-like guards to the ladder.

Although it is shown with a corrugated construction for purposes of adjusting and accommodating the interconnection of the guards to various side ladders, other variations in grooves within the straight telescoping body can of course be readily used. For example, the body portion may be formed with an essentially inner smooth surface with the outer surface grooved thereby effectively providing stretching and movement over different sized ladders with a minimum amount of difficulty.

The present invention provides a simple, reliable but effective ladder guard which can be conveniently and economically produced as by molding of the single piece ladder guard.

Various modes of carrying out the invention are contemplated as being within the scope of the following claims particularly pointing out and distinctly claiming the subject matter which is regarded as the invention.

I claim:

1. A ladder guard for securement to the upper end of the siderails of a ladder to provide a protective mounting against a vertical supporting wall structure, comprising an integrated cup-shaped member having a body portion with an open end and adapted to telescope in tight fitting engagement over the upper end of a siderail and an integrated outer end portion having a substantially curved configuration, said outer end having a substantially smooth continuous outer surface for engaging said supporting wall structure, said body portion having sidewall portions including a plurality of parallel grooves extending from said open end to said smooth curved end portion, said grooves terminating essentially at said outer end portion and creating limited flexibility of said body portion for telescoping engagement with different sized siderails.

2. The ladder guard of claim 1 wherein said cup-shaped member is a molded thermal plastic rubber.

3. The ladder guard of claim 1 wherein said body portion has a substantially rectangular configuration including a pair of main sidewalls of an essentially constant thickness connected to said pair of sidewalls having said plurality of parallel grooves.

4. The ladder guard of claim 3 wherein said outer end portion has an essentially constant thickness corresponding to said main sidewalls.

5. The ladder guard of claim 1 wherein said sidewall portions are serpentine in cross-section to define said parallel grooves and establishing expansion and contraction of said sidewall portions to establish said tight fitting engagement over the upper end of the sidewall.

6. The ladder guard of claim 5 wherein said integrated outer end portion has a constant thickness with smooth inner and outer wall surfaces.

7. The ladder guard of claim 5 wherein said body portion has a substantially rectangular configuration including a pair of main sidewalls formed as essentially smooth continuous members of an essentially constant thickness joining said grooved sidewalls portions.

8. The ladder guard for securement to the upper end of the siderails of a ladder to provide a protective mounting against a vertical supporting wall structure, comprising an integrated cup-shaped member having a body portion adapted to telescope in tight fitting engagement over the upper end of a siderail and an integrated outer end portion having a substantially curved configuration, said body portion having a substantially rectangular configuration including a pair of main sidewalls formed as essentially smooth continuous members of an essentially constant thickness and a pair of narrow sidewalls joining said main sidewall, said narrow sidewalls having a substantially accordian cross-section terminating essentially at said outer end portion and creating expansion and contraction of said body portions for telescoping engagement with different sized siderails.

* * * * *

UNITED STATES PATENT AND TRADEMARK OFFICE

CERTIFICATE OF CORRECTION

PATENT NO. : 4,771,862

DATED : September 20, 1988

INVENTOR(S) : Patrick J. Garland

It is certified that error appears in the above-identified patent and that said Letters Patent is hereby corrected as shown below:

Cancel "GUARDS" and substitute therefor ---TOP COVERS--- in the Title; cancel "guard" and substitute therefor ---top cover--- in the Abstract, lines 1 and 4; Col. 1, lines 7, 56; Col. 2, lines 6, 11, 25, 36, 38, 42 and 57; Col. 3, lines 15 and 51; Col. 4, lines 12, 27, 47, 49 and 55; Col. 5, lines 3, 5, 10, 13, 18 and 21, Col. 6, line 4; cancel "guard" and substitute therefor ---top covers--- in Col. 1, lines 1, 6, 59; Col. 3, lines 17, 28, 41, 44 and 55; Col. 4, lines 5, 9, 15, 34 and 38. cancel "guards" and substitute therefor -- top covers --.

Signed and Sealed this

Twenty-eighth Day of February, 1989

*Attest:*

DONALD J. QUIGG

*Attesting Officer*

*Commissioner of Patents and Trademarks*